US007036194B2

(12) United States Patent
Tricker

(10) Patent No.: US 7,036,194 B2
(45) Date of Patent: May 2, 2006

(54) SHOE LACE

(76) Inventor: Antoinette Tricker, 2 Fitzgerald Mews, Brook Farm Road, Saxmundham, Suffolk IP17 1XP (GB)

( * ) Notice: Subject to any disclaimer, the term of this patent is extended or adjusted under 35 U.S.C. 154(b) by 0 days.

(21) Appl. No.: 10/786,989

(22) Filed: Feb. 25, 2004

(65) Prior Publication Data

US 2005/0183250 A1 Aug. 25, 2005

(51) Int. Cl.
*A43C 7/00* (2006.01)
*A43C 9/06* (2006.01)

(52) U.S. Cl. ..... 24/713

(58) Field of Classification Search ..... 24/713, 24/713.1, 712.1, 712.2, 712.4, 712.9, 715.4; 36/50.1

See application file for complete search history.

(56) References Cited

U.S. PATENT DOCUMENTS 1,142,199 A * 6/1915 Olson ..... 24/713
1,458,088 A * 6/1923 Unnold ..... 24/713
1,530,690 A * 3/1925 Oliver ..... 24/18
2,049,932 A * 8/1936 Voit et al. ..... 24/713
2,306,515 A * 12/1942 Wright ..... 24/713
3,066,370 A * 12/1962 Epstein ..... 24/712.9
3,353,228 A * 11/1967 Kish et al. ..... 24/712.9
5,029,372 A 7/1991 Brinson
5,065,482 A * 11/1991 Lofy ..... 24/712.1
5,119,539 A * 6/1992 Curry ..... 24/712.1
5,239,732 A * 8/1993 Steven ..... 24/713
5,471,769 A * 12/1995 Sink ..... 36/50.1
6,473,944 B1 * 11/2002 Vazin ..... 24/712.9
2004/0261235 A1 * 12/2004 Funk ..... 24/712.9

FOREIGN PATENT DOCUMENTS

EP 0042811 A1 * 9/1984

* cited by examiner

*Primary Examiner*—Robert J. Sandy
(74) *Attorney, Agent, or Firm*—Andrus, Sceales, Starke & Sawall, LLP

(57) ABSTRACT

A shoe lace including a wired cord 3 fixed to a conventional end piece 5 at one end and a buckle or anchoring device 1 incorporating two holes 2 at the other. The lace is threaded across the shoe between two opposite eyelets only and fastened either by being twisted around the buckle 1 or by being threaded through the two holes 2 on the buckle 1, the number of laces used to tie the shoe being a matter of personal preference. Preferably the buckle 1 is made of a light plastic material but it can be made of metal or wood or any other suitable material or be of any shape or design.

2 Claims, 2 Drawing Sheets

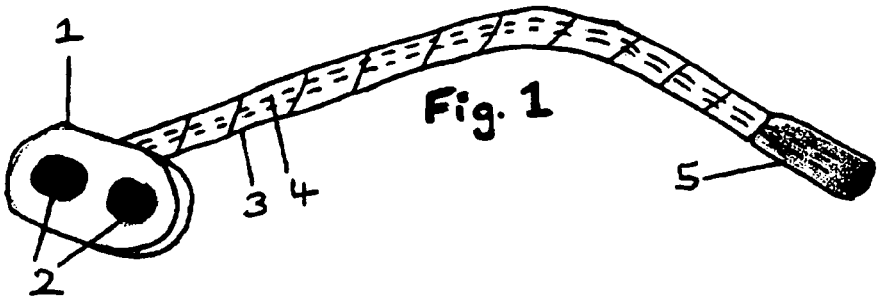
Fig. 1
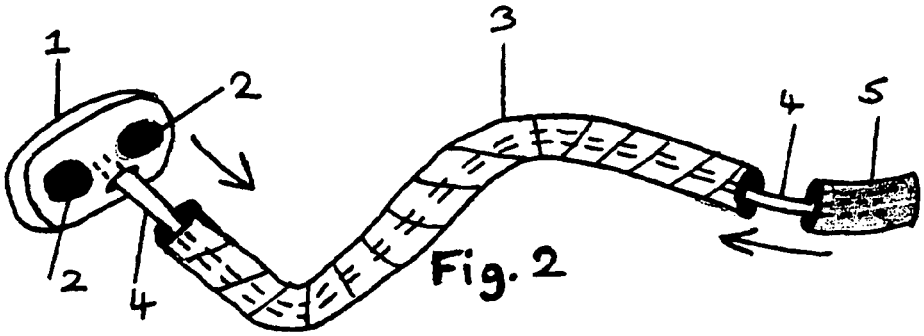
Fig. 2
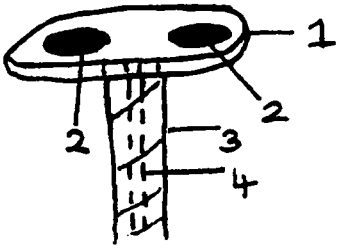
Fig. 3
Fig. 4
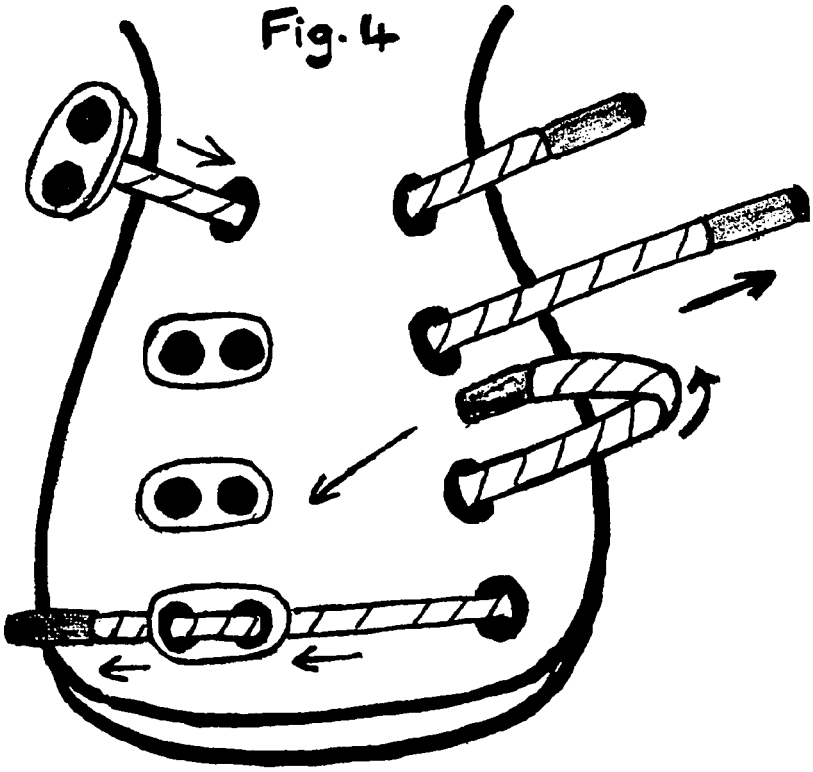

SHOE LACE

BACKGROUND OF THE INVENTION

This invention relates to a shoe lace for all types of shoes.

Traditional shoe laces can cause all sorts of problems for users. They have a habit of coming undone which can result in the user having to stoop down several times a day to re-tie them, or they can trail along the floor causing accidents. The tying process itself can prove difficult for the very young and the elderly, or for those with manual dexterity problems or mental disabilities, as can loosening a lace sufficiently to allow the user to place a foot into the shoe. It is also sometimes difficult to achieve a 'tight' feel to laces in sports footwear such as running shoes and football boots.

SUMMARY OF THE INVENTION

An object of this invention is to provide a lace which can be used either singly or in multiples of the use's choice, to overcome all the difficulties listed above.

Accordingly, this invention provides a shoe lace comprising a cord stiffened with soft wire, a conventional end piece at one end and a buckle or anchoring device incorporating two holes at the other, which is threaded singly between two opposite eyelets on a shoe and secured either by being twisted around the buckle or by being threaded through the two holes in the buckle.

Preferably the buckle is rounded and unobtrusive in design, and is made of a light plastic material, but it may instead be of any shape or design, and made from metal or wood or any combination of materials, or customized for purposes of fashion or individual preference.

BRIEF DESCRIPTION OF THE DRAWINGS

A preferred embodiment of the invention will now be described with reference to the accompanying drawings in which:

In the drawings:

FIG. 1 shows the outward appearance of the lace;

FIG. 2 shows a sectional view of the lace;

FIG. 3 shows a side view of the lace and buckle;

FIG. 4 depicts the threading process from insertion of the lace into the shoe's eyelets to fastening.

DETAILED DESCRIPTION OF THE INVENTION

Figure 5:
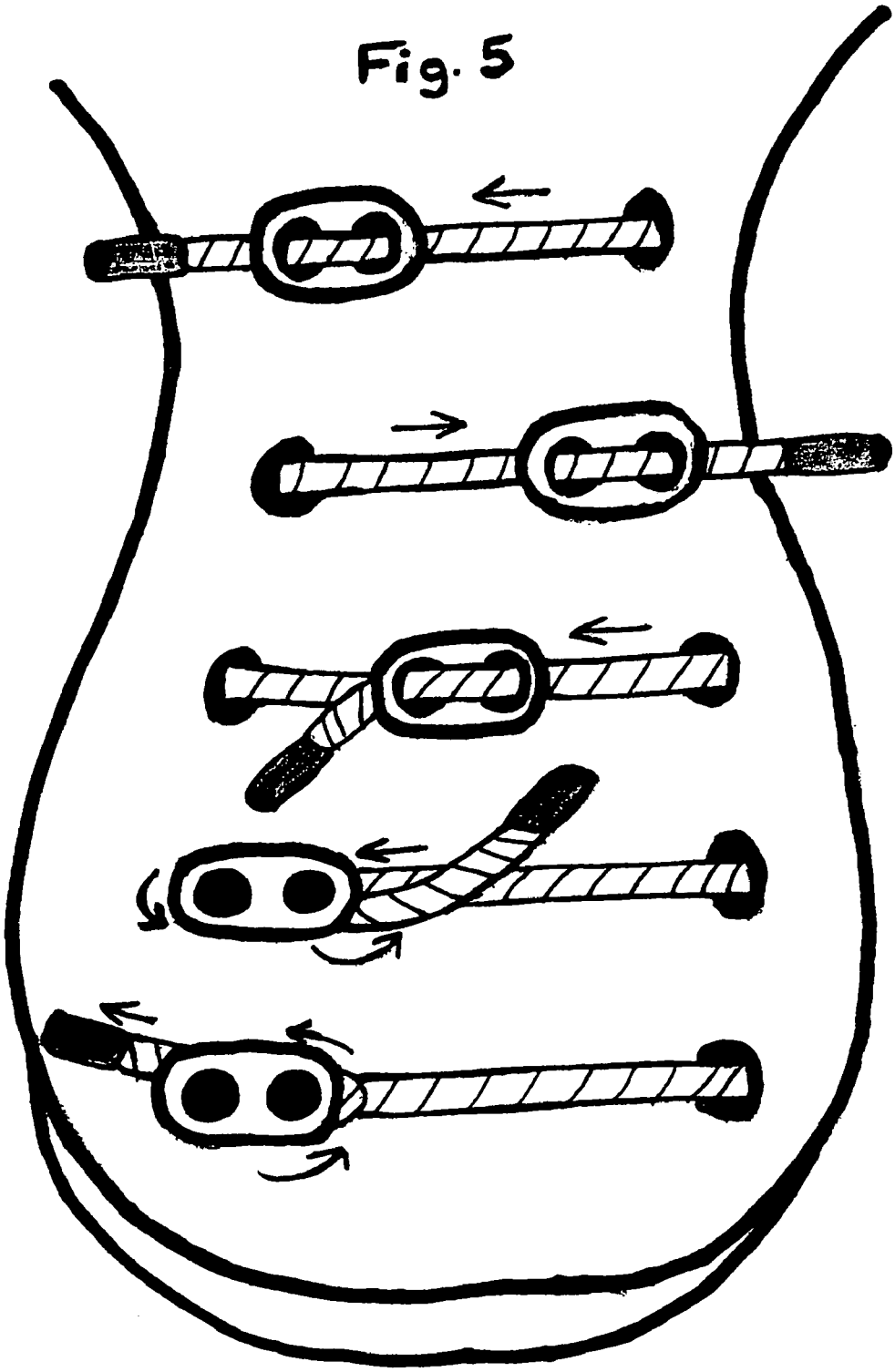
FIG. 5 illustrates the various methods of securing the lace to the buckle.

As shown in FIG. 1 the shoe lace comprises a cord 3 through which runs an inner core of soft wire 4, which is secured at one end by a traditional end piece 5 and at the other by a buckle 1 containing two holes 2. FIG. 2 is a sectional view of the lace showing the course of the inner wiring 4, while FIG. 3 depicts the lace 3 and buckle 1 from the side.

FIG. 4 gives a step-by-step breakdown of the threading process, while in FIG. 5 the various methods of securing the lace 3 around the buckle 1 are shown. The first two examples show the lace 3 threaded through the buckle 1 and positioned to either side of the shoe, the third example shows the lace 3 threaded in the same way but centered, while the last two illustrations show the lace 3 having been twisted around the buckle 1.

I claim:

1. A shoe lace comprising a cord stiffened with soft wire, a conventional end piece at one end and a buckle or anchoring device incorporating two holes at the other, which one end and conventional end piece are not threaded through all eyelets on a shoe, but are adapted only to be threaded through a first eyelet on a shoe and are then threaded through a second opposite eyelets on the shoe, the one end then being secured to the buckle or anchoring device by being twisted therearound or by being threaded through the two holes in the buckle.

2. A shoe lace as claimed in claim 1 wherein the buckle or anchoring device is made from plastic, metal or wood.

* * * * *